US008045872B2

(12) United States Patent
Hirata et al.

(10) Patent No.: US 8,045,872 B2
(45) Date of Patent: Oct. 25, 2011

(54) IMAGE-FORMING APPARATUS CONTAINING ELECTROPHOTOGRAPHIC SYSTEM AND IMAGE-FORMING METHOD

(75) Inventors: Katsuyuki Hirata, Toyokawa (JP); Kazuomi Sakatani, Toyokawa (JP); Toshikuni Ando, Toyokawa (JP); Kiyohito Tsujihara, Hoi-gun (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 675 days.

(21) Appl. No.: 12/170,907

(22) Filed: Jul. 10, 2008

(65) Prior Publication Data

US 2009/0016773 A1 Jan. 15, 2009

(30) Foreign Application Priority Data

Jul. 13, 2007 (JP) ..... 2007-184199

(51) Int. Cl.
*G03G 15/00* (2006.01)

(52) U.S. Cl. ..... 399/49

(58) Field of Classification Search ..... 399/49, 399/301

See application file for complete search history.

(56) References Cited

U.S. PATENT DOCUMENTS 7,515,843 B2 * 4/2009 Bonino et al. ..... 399/49

FOREIGN PATENT DOCUMENTS

JP 09-190141 7/1997
JP 2007-017666 A 1/2007

OTHER PUBLICATIONS

Notification of Reasons for Refusal in JP 2007-184199 dated Jun. 9, 2009, and an English Translation thereof.

* cited by examiner

*Primary Examiner* — William J Royer
(74) *Attorney, Agent, or Firm* — Buchanan Ingersoll & Rooney PC

(57) ABSTRACT

An image-forming apparatus includes:

an optical sensor that includes a light source unit which applies light having a light-emission main wavelength λ to a peripheral face of an image-supporting member, and a light-receiving unit which receives a reflected light thereof, so as to optically detect a toner pattern formed on a peripheral face of the image-supporting member, wherein the image-supporting member has at least one thin-film layer formed on the peripheral face thereof, and the thickness of an outermost surface thin-film layer is set so as to allow a reflectance function R(d) that indicates the relationship between a reflectance R of the peripheral face of the image-supporting member to light having a light-emission main wavelength λ from the light source unit and a thickness d (nm) of the outermost surface thin-film layer of the image-supporting member to satisfy:

$$R(d) \geqq 0.75 \times \{R\max(d) - R\min(d)\} + R\min(d).$$

8 Claims, 8 Drawing Sheets

IMAGE-FORMING APPARATUS CONTAINING ELECTROPHOTOGRAPHIC SYSTEM AND IMAGE-FORMING METHOD

This application is based on application No. 2007-184199 filed in Japan, the content of which is hereby incorporated by reference.

BACKGROUND OF THE INVENTION

1. Field of the Invention

The present invention relates to an image-forming apparatus and an image-forming method, in which an electrophotographic system is adopted. More specifically, the present invention relates to an image-forming apparatus used for forming color and monochrome images, such as a copying machine, a printer and a facsimile, and a corresponding image-forming method. In particular, the present invention relates to an image-forming apparatus and an image-forming method, which form an image by transferring a toner image formed on an image-supporting member onto a recording medium.

2. Description of the Related Art

In the conventional image-forming apparatus that uses an electrophotographic system, an image-forming apparatus, in which an intermediate transfer system is adopted has been known. In this system, upon transferring a toner image on a photosensitive member onto a recording material, an intermediate transfer member is used. More specifically, after a toner image on the photosensitive member has been once primary-transferred onto the intermediate transfer member, the toner image on the intermediate transfer member is secondary-transferred onto a recording material. In most cases, the intermediate transfer system is adopted as a multiple transfer system for toner images of respective colors in a so-called full-color image-forming apparatus in which a document image, which has been color-decomposed, is reproduced by a subtractive color mixing process using toners having respective colors of black, cyan, magenta, yellow and the like. However, in the multiple transfer system by the use of the intermediate transfer member, two transferring processes, that is, a primary transferring process and a secondary transferring process, are required, and since toner images of four colors are superposed on the intermediate transfer member, a problem arises in which a defective image tends to be formed due to defective transfer.

In order to solve this problem, a technique (JP-A No. 2007-17666) in which an inorganic compound layer is formed on the surface of an intermediate transfer member by using a plasma CVD method and a technique in which a ceramic film is formed on the surface of an intermediate transfer member have been proposed. By using such techniques, the peeling property of a toner image from the intermediate transfer member is improved so that the transferring efficiency onto a recording material or the like can be improved.

In the image-forming apparatus that uses the electronic photographic system, image-stabilizing control is generally carried out in order to maintain the image density within a predetermined range. More specifically, a predetermined toner pattern is formed on an image-supporting member typically represented by an intermediate transfer belt or the like, and this is detected by an optical sensor. The optical sensor includes a light-source unit that applies light having a specific waveform length to the peripheral face of the image-supporting member and a light-receiving unit that receives its reflected light. Light is applied onto the toner pattern on the peripheral face of the image-supporting member from the light-source unit of the optical sensor, and the light-receiving unit receives its reflected light so that based upon the quantity of received light, the amount of adhered toner (toner density) of the toner pattern is detected. Based upon the results, process conditions are altered so that the image density can be maintained within the predetermined range.

However, in the case when a thin-film layer, such as an inorganic compound layer and a ceramic film, is formed on the surface of the intermediate transfer member as described above, when the image-stabilizing control is carried out, an optical interference occurs due to influences of optical characteristics between the optical sensor and the thin-film layer. Moreover, since, upon detecting the toner pattern, the detecting operation is carried out, with the intermediate transfer member being driven, the optical thickness of a pattern detection area fluctuates due to fluctuation factors, such as thickness nonuniformity and jouncing of the intermediate transfer member thin-film layer, with the result that the optical interference becomes conspicuous. In particular, since fluctuations in reflectance due to the thickness nonuniformity of the thin-film layer occur remarkably, the calibration of the optical sensor and the detection of the toner pattern are not carried out accurately, resulting in a problem of failure in maintaining the image density within the predetermined range.

SUMMARY OF THE INVENTION

An object of the present invention is to provide an image-forming apparatus and an image-forming method in the case when an image-supporting member has a thin-film layer, in which optical interference due to the thin-film layer, in particular, fluctuations in reflectance due to thickness nonuniformity of the outermost surface thin-film layer can be restrained, and consequently image-stabilizing control can be made effectively.

The above object can be achieved by an image-forming apparatus, comprising:

an optical sensor that includes a light source unit which applies light having a light-emission main wavelength $\lambda$ to a peripheral face of an image-supporting member, and a light-receiving unit which receives a reflected light thereof, so as to optically detect a toner pattern formed on a peripheral face of the image-supporting member, wherein the image-supporting member has at least one thin-film layer formed on the peripheral face thereof, and the thickness of an outermost surface thin-film layer is set so as to allow a reflectance function R(d) that indicates the relationship between a reflectance R of the peripheral face of the image-supporting member to light having a light-emission main wavelength $\lambda$ from the light source unit and a thickness d (nm) of the outermost surface thin-film layer of the image-supporting member to satisfy the following conditional expression:

$$R(d) \geqq 0.75 \times \{R_{max}(d) - R_{min}(d)\} + R_{min}(d)$$

in which d is set in a range of $0<d<1000$ nm;

$R_{max}$ (d) is a maximum value that the reflectance function R(d) is allowed to have; and $R_{min}$ (d) is a minimum value that the reflectance function R(d) is allowed to have.

BRIEF DESCRIPTION OF THE DRAWINGS

FIG. 15 is a view that shows the relationship between a rate of an output change to the belt base face output, $V_{base}_\Delta$, and a coefficient a.

DETAILED DESCRIPTION OF THE INVENTION

Figure 1:
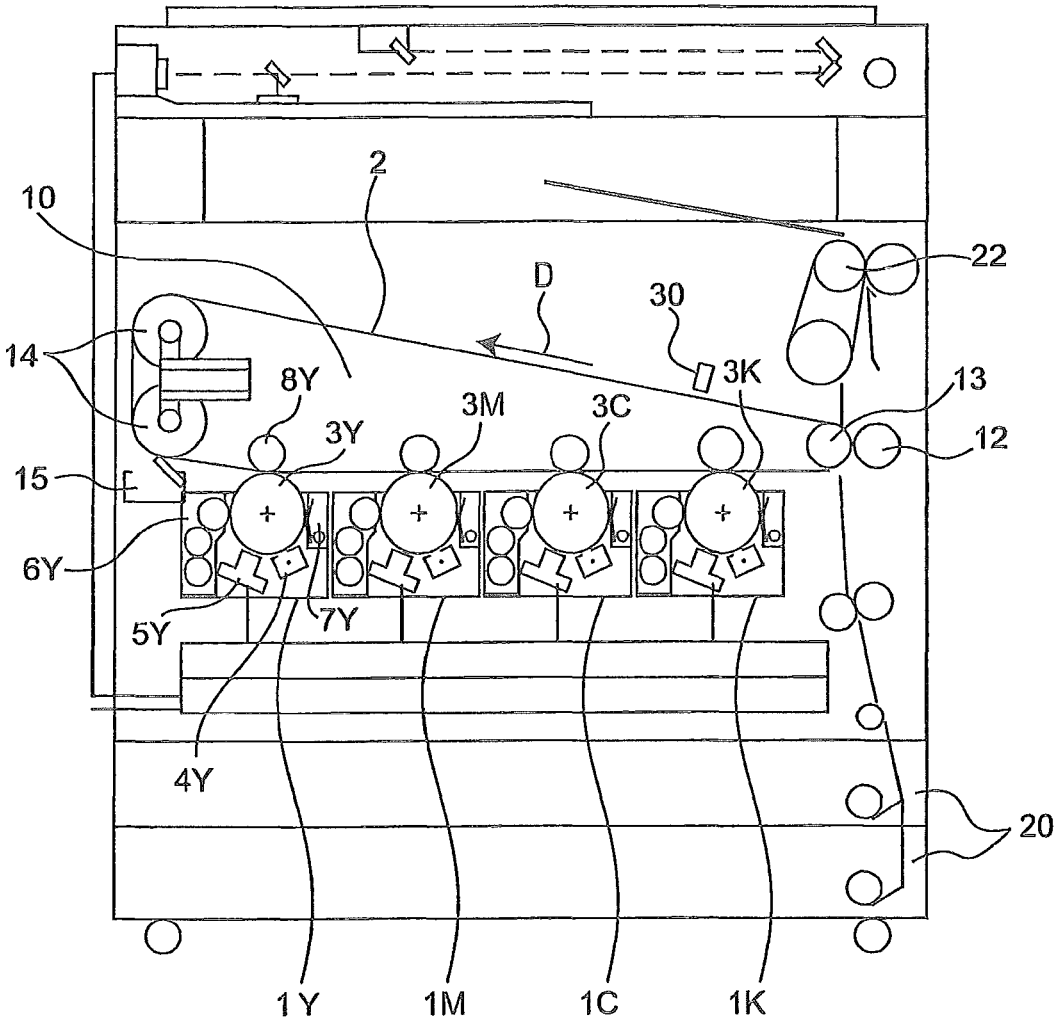
FIG. 1 is a schematic view that shows the entire structure of one embodiment of an image-forming apparatus in accordance with the present invention.

The present invention relates to an image-forming apparatus that is provided with: an optical sensor that includes a light source unit which applies light having a light-emission main wavelength λ to a peripheral face of an image-supporting member, and a light-receiving unit which receives a reflected light thereof, so as to optically detect a toner pattern formed on a peripheral face of an image-supporting member, and in this structure, the image-supporting member has at least one thin-film layer formed on the peripheral face thereof, and a thickness of the outermost surface thin-film layer is set so as to allow a reflectance function R(d) that indicates the relationship between a reflectance R of the peripheral face of the image-supporting member to light having a light-emission main wavelength λ, from the light source unit and a thickness d (nm) of the outermost surface thin-film layer of the image-supporting member to satisfy the following conditional expression:

$$R(d) \geqq 0.75 \times \{R_{max}(d) - R_{min}(d)\} + R_{min}(d)$$

in the expression, d is set in a range of 0<d<1000 nm; $R_{max}$ (d) is a maximum value that the reflectance function R(d) is allowed to have; and $R_{min}$ (d) is the minimum value that the reflectance function R(d) is allowed to have.

The present invention also relates to the above-mentioned image-forming apparatus in which the reflectance function R(d) that indicates the relationship between the reflectance R of the peripheral face of the image-supporting member to light having a light-emission main wavelength λ from the light source unit and the thickness d (nm) of the outermost surface thin-film layer of the image-supporting member is allowed to satisfy the following conditional expression:

$$R(d) \geqq 0.85 \times \{R_{max}(d) - R_{min}(d)\} + R_{min}(d).$$

The present invention also relates to the above-mentioned image-forming apparatus in which the thin-film layer is an inorganic oxide layer formed by using an atmospheric pressure plasma CVD method.

The present invention also relates to an image-forming method which transfers a toner image formed on an image-supporting member onto a recording medium to form an image thereon, and is provided with the steps of: forming a toner pattern on a peripheral face of the image-supporting member having at least one thin-film layer on the peripheral face thereof; applying light having a light-emission main wavelength λ to the peripheral face of the image-supporting member; receiving reflected light of the applied light from the image-supporting member; and carrying out image-stabilizing control, which sets toner image forming conditions based upon the intensity of the reflected light thus received, wherein a reflectance function R(d) that indicates the relationship between a reflectance R of the peripheral face of the image-supporting member to light having a light-emission main wavelength λ and a thickness d (nm) of the outermost surface thin-film layer of the image-supporting member is allowed to satisfy the following conditional expression:

$$R(d) \geqq 0.95 \times \{R_{max}(d) - R_{min}(d)\} + R_{min}(d)$$

in the expression, d is set in a range of 0<d<1000 nm; $R_{max}$ (d) is the maximum value that the reflectance function R(d) is allowed to have; and $R_{min}$ (d) is the minimum value that the reflectance function R(d) is allowed to have.

By setting the thickness of the outermost surface thin-film layer so as to allow the reflectance function R(d) to satisfy the above-mentioned conditional expression, it becomes possible to restrain optical interference that is caused due to influences of the optical characteristics between the optical sensor and the thin-film layer and optical interference that is caused due to fluctuation factors such as fluctuations in thickness and jouncing of the image-supporting member. In particular, fluctuations in reflectance due to thickness variation in the outermost surface thin-film are restrained. As a result, since an erroneous detection on the toner pattern and the image-supporting member peripheral face can be prevented, it becomes possible to accurately carry out calibration of the optical sensor and detection of the toner pattern, and consequently to effectively carry out image-stabilizing control.

The image-forming apparatus according to the present invention, which carries out an image stabilizing control process regularly, detects a change in image density that might be caused by various factors such as an environmental change and the number of prints, and controls the image density to an appropriate range. That is, a predetermined toner pattern formed on the peripheral face of the image-supporting member is optically detected by an optical sensor. Based upon the results, the image stabilizing control process is carried out. Referring to FIGS. 1 to 8, the following description will discuss the image-forming apparatus of the present invention in detail. In the present invention, it is only necessary for the image-supporting member to have at least one thin-film layer on the peripheral face and also to support toner (image) on the peripheral face so as to carry the toner, and, for example, so-called intermediate transfer member and photosensitive member can be used. The image-supporting member may have either a belt shape or a drum shape. The following description will discuss the apparatus in which an intermediate transfer belt is used as an image-supporting member in detail; however, based upon the following explanation, it is clear that the object of the present invention can be achieved even by the use of another image-supporting member.

FIG. 1 is a schematic structural view that shows one example of an image-forming apparatus of the present invention. The image-forming apparatus shown in FIG. 1 is provided with imaging units 1Y, 1M, 1C and 1K (hereinafter, referred to as 1 collectively) used for forming a toner image, an intermediate transfer belt 2 for supporting toner images formed by the imaging units 1 and an optical sensor 30 used for optically detecting a predetermined toner pattern supported on the intermediate transfer belt 2 upon conducting image-stabilizing control. Each of the imaging units 1 has a photosensitive member (3Y, 3M, 3C, and 3K) as well as a charging unit (for example, 4Y), an exposing unit (for example, 5Y), a developing unit (for example, 6Y) and a cleaning unit (for example, 7Y), that are placed on the periphery thereof. In an intermediate transfer unit 10, on the periphery of the intermediate transfer belt 2 that is passed over a driving roller 13 and extension rollers 14, primary transfer rollers (for example, 8Y) used for primary-transferring toner images formed on the photosensitive members 3Y, 3M, 3C and 3K onto the intermediate transfer belt 2, a secondary transfer roller 12 used for further secondary-transferring the toner images transferred on the intermediate transfer belt 2 onto a recording material and a cleaning unit 15 used for removing residual toner on the intermediate transfer belt 2 are placed. In the image-forming apparatus of FIG. 1, the recording materials are housed in a lower portion of the apparatus, and taken out by a pickup unit 20, and after the toner images have been secondary-transferred thereon by the secondary transfer roller 12, the resulting toner image is fixed in a fixing unit 22, and the resulting recording material is discharged onto an upper portion of the apparatus. FIG. 1 shows a tandem-type full-color image-forming apparatus as an image-forming apparatus; however, those having another structure may be used, and, for example, a so-called 4-cycle full-color image-forming apparatus may be used.

Figure 2:
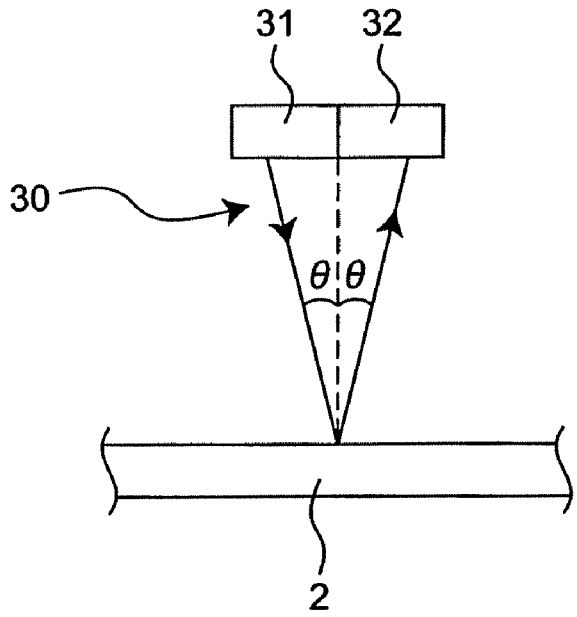
FIG. 2 is a schematic structural view that explains the relationship between an optical sensor and an intermediate transfer belt.

For example, as shown in FIG. 2, the optical sensor 30 is constituted by a light source unit 31, which applies light having a light emission main wavelength λ to the peripheral face of the intermediate transfer belt 2, and a light-receiving unit 32, which receives its reflected light, and these are placed so that the respective light incident angle and light receiving angle of the light source unit 31 and the light-receiving unit 32 have the same value θ. FIG. 2, which is a schematic structural view that explains the relationship between the optical sensor 30 and the intermediate transfer belt 2, forms a cross-sectional structural view perpendicular to a driving direction D of the intermediate transfer belt 2 of FIG. 1.

The optical sensor 30 optically detects a toner pattern that is formed on the peripheral face of the intermediate transfer belt 2 at the time of an image stabilizing control process that is carried out regularly. Detecting the toner pattern optically corresponds to the process in which light is applied to the toner pattern by the light source unit 31, and by measuring the amount of received light of its reflected light by the light-receiving unit 32, the amount of adhered toner (toner density) of the toner pattern is detected. In the light-receiving unit 32, since the quantity of received light of the reflected light is normally obtained as a voltage value that is outputted in accordance with its intensity, the amount of adhered toner of the toner pattern is detected based upon the known relationship between the amount of adhered toner and the output value of the optical sensor 30.

By adjusting and altering process conditions based upon such a result of detection of the amount of adhered toner, the image density is maintained within an appropriate range, and the image-stabilizing control process is consequently achieved.

With respect to the process conditions to be adjusted and altered to control the image density, for example, factors, such as a developing bias, a developing DUTY, a level of image data and an LD light quantity, are listed.

More specifically, in the case when the amount of adhered toner of the toner pattern is below a predetermined range, the developing bias is raised, the developing DUTY is increased, the level of image data is raised, or the LD light quantity is raised; thus, the amount of adhered toner is increased. As a result, the image density is consequently made higher.

For example, in the case when the amount of adhered toner of the toner pattern is higher than the predetermined range, the developing bias is lowered, the developing DUTY is reduced, the level of image data is lowered, or the LD light quantity is lowered; thus, the amount of adhered toner is reduced. As a result, the image density is consequently made lower.

Figure 3:
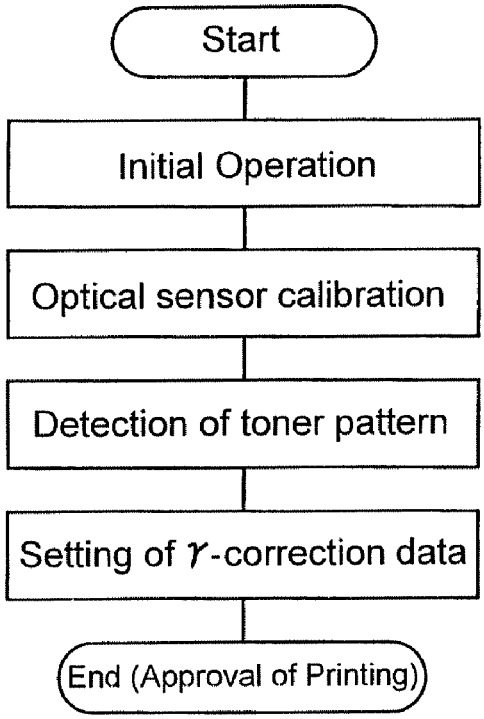
FIG. 3 is a flowchart that shows operations of image-stabilizing control.

Referring to a flowchart of FIG. 3, the following description will discuss one example of specific operations of image-stabilizing control.

(Initial Operation)

Upon receipt of a request for executing image-stabilizing control, first, the imaging units 1 and the intermediate transfer belt 2 are driven to carry out initial operations (preparation) for pattern detection.

(Optical Sensor Calibration)

After completion of the initial operations, calibration control of the optical sensor 30 is carried out. In the calibration control of the optical sensor 30, first, light having a light emission main wavelength λ is applied to the intermediate transfer belt 2 from the light-source unit 31, with no toner pattern being formed on the peripheral face of the intermediate transfer belt 2. Next, the reflected light is received by the light-receiving unit 32 and the quantity of light emission is adjusted so that the output of the quantity of received light is set to a predetermined value (output of belt base face: Vbase). The output of belt base face refers to a voltage output value of a quantity of received light, with no toner pattern being formed on the intermediate transfer belt 2.

(Detection of Toner Pattern)

Then, a toner pattern is formed, and a detecting process thereof is carried out.

Figure 4:
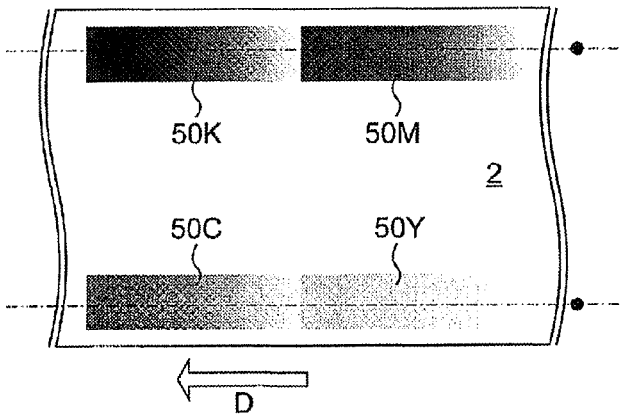
FIG. 4 is a schematic view that shows one example of a pattern to be detected in the image-stabilizing control.
Figure 5:
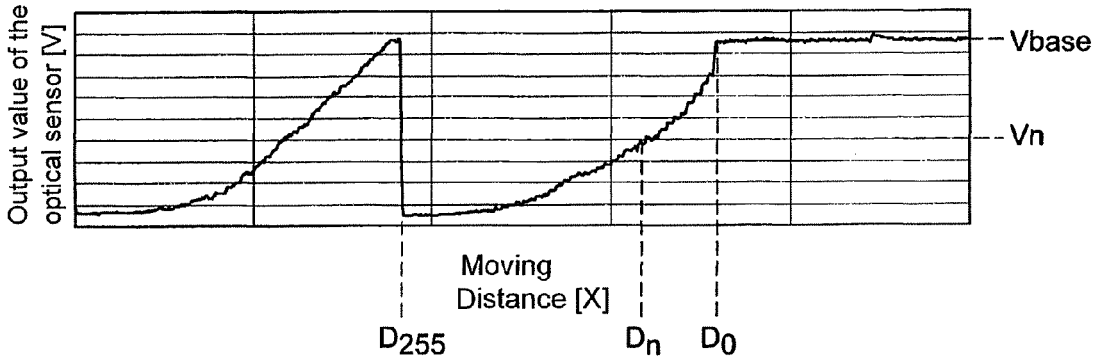
FIG. 5 is a view that shows an optical sensor output upon detection of the pattern in the image-stabilizing control.

Not particularly limited, those patterns that have been conventionally used may be adopted as a toner pattern to be used for the image-stabilizing control. For example, as shown in FIG. 4, continuous gradation patterns 50Y, 50M, 50C and 50K each of which has gradation levels (Dn) that vary step by step from 255 gradations ($D_{225}$) to 0 gradation ($D_0$) for each of the colors are used. After forming such a toner pattern onto the peripheral face of the intermediate transfer belt 2 by the imaging units 1, the toner pattern on the intermediate transfer belt 2 is optically detected by the optical sensor 30, with the intermediate transfer belt 2 being driven. Here, in the case when the toner patterns shown in FIG. 4 are used, total two optical sensors, that is, an optical sensor 30 used for detecting the black toner pattern 50K and the magenta toner pattern 50M and an optical sensor 30 used for detecting the cyan toner pattern 50C and the yellow toner pattern 50Y, are required. The detected waveforms have shapes, for example, shown in FIG. 5. The detected voltage value (Vn) corresponding to each of the gradation levels (Dn) and the output of belt base face ($V_{base}$) are subjected to a standardizing process by using the following equation so that a standardized value (Sn) is calculated.

$$Sn=255\times Vn/V_{base}$$

(Setting of γ-Correction Data)

After altering the above-mentioned process conditions and adjusting the maximum density, the image density value is converted to a value corresponding to the standardized value (Sn) for each of the gradations, obtained in the above-mentioned process, and a gradation correction table is formed based upon the density data of the respective gradations, obtained thereafter, so as to update the data.

By carrying out these processes, the gradation characteristics of a multicolor image to be outputted can be changed linearly, thereby making it possible to output a good image.

Figure 6:
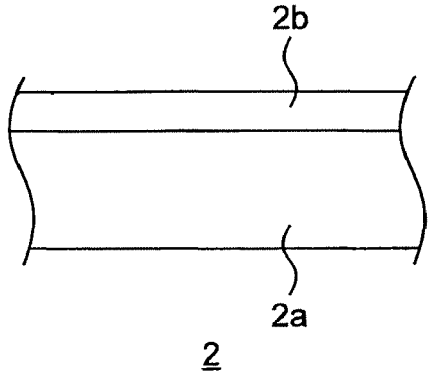
FIG. 6 is a schematic cross-sectional view that shows an intermediate transfer member having a single-layer structure in which a single thin-film layer is formed on a substrate.

In the present invention, the intermediate transfer belt 2 is designed to have at least one thin-film layer on the peripheral face thereof, and may be prepared as that of a single-layer type in which, for example, as shown in FIG. 6, one thin-film layer 2*b* is formed on a substrate 2*a*, or that of a multi-layer type in which one or more other layers are formed between the substrate 2*a* and the thin-film layer 2*b*. In the present specification, the thin-film layer 2*b* of the intermediate transfer belt 2 of the single-layer type and the thin-film layer on the outermost surface of the intermediate transfer belt of the multi-layer type are collectively referred to as an outermost surface thin-film layer 2*b*.

Although not particularly limited, the substrate 2*a* is preferably designed to have a volume resistivity in a range from $1\times10^{6}$ Ω·cm to $1\times10^{12}$ Ω·cm, and normally formed into a seamless belt. For example, it is made from a material formed by dispersing a conductive filler such as carbon in the following resin materials or by adding an ionic conductive material to the following resin materials: polycarbonate (PC); polyimide (PI); polyamideimide (PAT); and polyphenylene sulfide (PPS). The thickness of the substrate 2*a* is normally set in a range from 50 to 1000 μm.

The outermost surface thin-film layer 2*b*, which exerts a releasing property against toner, is prepared, for example, as an inorganic-based thin-film layer such as an inorganic oxide layer.

The inorganic oxide layer is preferably made from a material containing at least one oxide selected from $SiO_2$, $Al_2O_3$, $ZrO_2$, $TiO_2$, and in particular, $SiO_2$ is preferable. The inorganic oxide layer is preferably formed by using a plasma CVD method in which a plasma is formed from a mixed gas containing at least a discharge gas and a material gas for the inorganic oxide layer and deposits and forms a film in accordance with the material gas, in particular, by using an atmospheric pressure plasma CVD method carried out under atmospheric pressure or under near atmospheric pressure.

In the present invention, the thickness d of such an outermost surface thin-film layer 2*b* is set so as to allow the reflectance function R(d) of the intermediate transfer belt 2 to satisfy the following conditional expression:

$$R(d)\geqq 0.75\times\{R_{max}(d)-R_{min}(d)\}+R_{min}(d) \quad \text{(Expression X);}$$

preferably, $$R(d)\geqq 0.85\times\{R_{max}(d)-R_{min}(d)\}+R_{min}(d) \quad \text{(Expression Y);}$$

more preferably, $$R(d)\geqq 0.95\times\{R_{max}(d)-R_{min}(d)\}+R_{min}(d) \quad \text{(Expression Z).}$$

In the expressions X to Z, d represents a thickness of the outermost surface thin-film layer 2*b*, which is not particularly limited as long as it satisfies the above-mentioned conditional expressions. For example, from the viewpoints of preventing cracks and peeling of the corresponding layer, d is preferably set in a range of $0<d<1000$ nm, particularly in a range of $200\leqq d\leqq 500$ nm.

$R_{max}$ (d) is the maximum value that the reflectance function R(d) is allowed to have.

$R_{min}$ (d) is the minimum value that the reflectance function R(d) is allowed to have.

Figure 7:
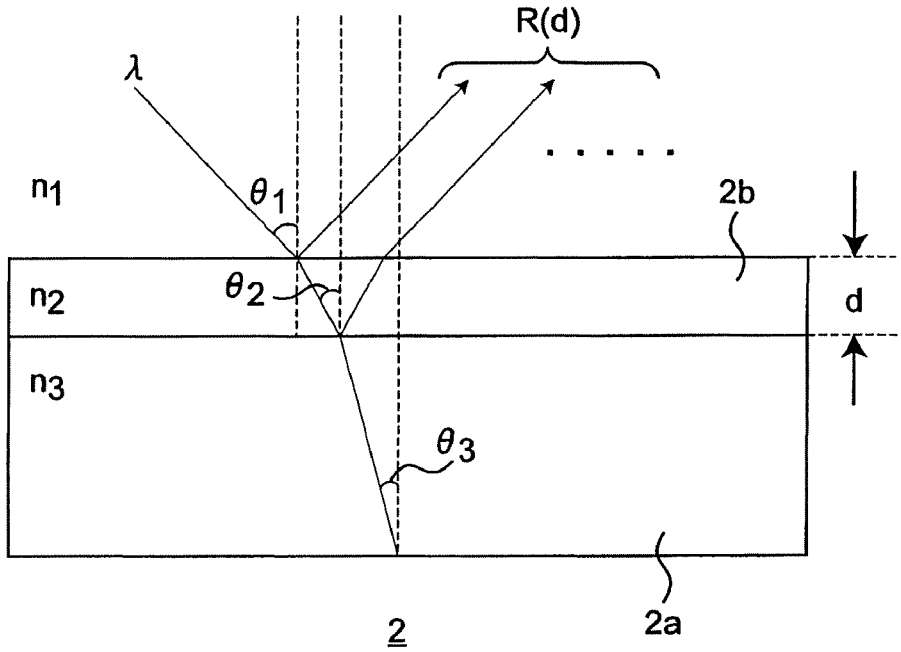
FIG. 7 is a schematic view that shows a thin-film interference model exerted on the intermediate transfer member of FIG. 6.

In general, the outermost surface thin-film layer 2*b* is hardly made to have a strictly even thickness; therefore, when the reflectance is measured by detecting the light receiving quantity of reflected light with the intermediate transfer belt 2 being driven, the reflectance fluctuates due to thickness nonuniformity independent of the presence or absence of a toner pattern on the intermediate transfer belt 2. FIG. 7 is a schematic view that explains the mechanism of occurrence of fluctuations in reflectance. FIG. 7 schematically shows optical interferences that are exerted upon irradiating the intermediate transfer belt 2 with light (main wavelength λ) from the light-source unit 31 of the optical sensor 30, and indicates that interferences occur in reflected light at least on an interface between an air layer (refractive index $n_1$) and the outermost surface thin-film layer 2*b* (refractive index $n_2$) as well as on an interface between the outermost surface thin-film layer 2*b* (refractive index $n_2$) and the substrate 2*a* (refractive index $n_3$). On the paper face of FIG. 7, a direction D from the surface to the rear surface corresponds to the driving direction of the intermediate transfer belt 2. In the case when a detecting operation is carried out by driving the intermediate transfer belt 2, with such optical interferences occurring, fluctuations in the reflectance R(d) become conspicuous due to irregularity in the thickness of the outermost surface thin-film layer 2*b*. However, in the present invention, by setting the thickness d of the outermost surface thin-film layer 2*b* so as to satisfy the above-mentioned conditional expressions, the fluctuations in the reflectance can be minimized, and effectively restrained, even when irregularities are present in the thickness. Consequently, the calibration of the optical sensor 30 and the detection of the toner pattern can be carried out comparatively precisely so that it becomes possible to effectively carry out the image-stabilizing control. In the case when the thickness d fails to satisfy the above-mentioned conditional expressions, fluctuations in the reflectance function R(d) due to thickness nonuniformity become conspicuous, failing to effectively carry out the image-stabilizing control.

Figure 8:
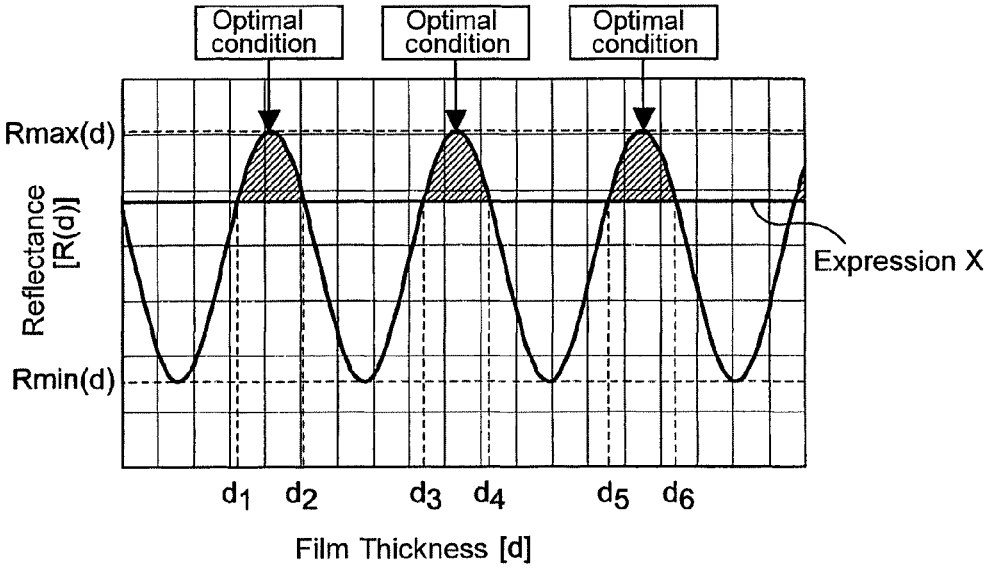
FIG. 8 is a view that shows the relationship between a reflectance function R(d) and the thickness d of an outermost surface thin-film layer.

The reflectance function R(d) represents the relationship between the reflectance R of the peripheral face of the intermediate transfer belt 2 to light having a light emission main wavelength λ and the thickness d (nm) of the outermost surface thin-film layer 2*b* of the intermediate transfer belt 2, with no toner being supported thereon, and it forms a waveform having a periodic characteristic as shown in FIG. 8. In the reflectance function R(d) of this kind, the area that satisfies the above-mentioned expression X corresponds to an area with slanting lines in FIG. 8, and the thickness d of the outermost surface thin-film layer 2*b* is effectively set, for example, within a range from $d_1$ to $d_2$ (nm), a range from $d_3$ to $d_4$ (nm) and a range from $d_5$ to $d_6$ (nm). Since the reflectance function R(d) has the periodic characteristic as described above, the thickness range of the outermost surface thin-film layer 2*b*, which is settable in the present invention, is not particularly limited by the above-mentioned three ranges. For example, supposing that the cycle of the reflectance function R(d) is $d_p$ (nm) and that the minimum settable range is "$d_1$ to $d_2$" (nm), the thickness range of the outermost surface thin-film layer 2*b* that is settable in the present invention can be generally indicated by "$d_1+n\cdot d_p \sim d_2+n\cdot d_p$" (nm) (n is a natural number). In FIG. 8, "$d_3 \sim d_4$" correspond to "$d_1+d_p \sim d_2+d_p$" and "$d_5 \sim d_6$" correspond to "$d_1+2d_p \sim d_2+2d_p$". The equation x of FIG. 8 forms a straight line corresponding to the following equation:

$$R(d)=0.75\times\{R_{max}(d)-R_{min}(d)\}+R_{min}(d).$$

The thickness d of the outermost surface thin-film layer 2*b* is indicated by a value obtained by averaging measured values taken at arbitrary 13 points by the use of a thin-film film-thickness meter (made by Mamiya Digital Imaging Co., Ltd.).

The reflectance function R(d) can be easily obtained through matrix calculations by the use of a matrix method.

For example, in the case when the intermediate transfer belt 2 has a single layer structure in which a single outermost surface thin-film layer 2*b* is formed on the substrate 2*a*, the reflectance function R(d) can be represented by the following equations:

$$R(d) = 0.5 \times \left(\frac{A^2 + B^2 + 2AB\cos 2\delta}{1 + A^2 + B^{2+}2AB\cos 2\delta} + \frac{C^2 + D^2 + 2CD\cos 2\delta}{1 + C^2 + D^2 + 2CD\cos 2\delta}\right) \quad \text{[Equation 1]}$$

$$A = \frac{n_2\cos\theta_1 - n_1\cos\theta_2}{n_2\cos\theta_1 + n_1\cos\theta_2}$$

$$B = \frac{n_3\cos\theta_2 - n_2\cos\theta_3}{n_3\cos\theta_2 + n_2\cos\theta_3}$$

$$C = \frac{n_1\cos\theta_1 - n_2\cos\theta_2}{n_1\cos\theta_1 + n_2\cos\theta_2}$$

$$D = \frac{n_2\cos\theta_2 - n_3\cos\theta_3}{n_2\cos\theta_2 + n_3\cos\theta_3}$$

$$\delta = \frac{2\pi\pi_2 d\cos\theta_2}{\lambda}$$

In the equation, λ represents a main wavelength of light to be applied upon carrying out image-stabilizing control. For example, this is set to 730 nm.

$n_1$ is a refractive index of air, and is normally 1.00 that is virtually the same as in vacuum;

$\theta_1$ represents an incident angle at which applied light is made incident on the interface to the outermost surface thin-film layer 2*b* from the air side upon carrying out the image-stabilizing control, and is normally set in a range from 0 to 90';

$n_2$ is the refractive index of the outermost surface thin-film layer 2*b*, and is normally set in a range from 1 to 4;

$\theta_2$ represents an incident angle at which applied light is made incident on the interface to the substrate 2*a* from the outermost surface thin-film layer 2*b* side upon carrying out the image-stabilizing control, and is normally set in a range from 0 to 90';

$n_3$ is the refractive index of the substrate 2*a*, and is normally set in a range from 1 to 4;

$\theta_3$ represents an incident angle at which applied light is made incident on the interface to air from the base substrate 2*a* side upon carrying out the image-stabilizing control, and is normally set in a range from 0 to 90'; and d represents the thickness of the outermost surface thin-film layer 2*b* as described earlier.

For example, in the case when the intermediate transfer belt 2 has a multiple layer structure in which specific thin-film layer and outermost surface thin-film layer 2*b* are successively formed on a substrate 2*a*, the reflectance function R(d) can be obtained through calculations by the use of a known matrix method. In this case, supposing that the thickness of the thin-film layer is a fixed value, the thickness d of the outermost surface thin-film layer 2*b* is set so as to allow R(d) to satisfy the above-mentioned conditional expressions. The thin-film layer may be composed of two or more layers.

EXAMPLES

Experimental Example 1

Reference Example (Production of Transfer Belt)

A substrate having a seamless shape, which was made from a PPS resin having carbon dispersed therein and had a thickness of 150 μm, was obtained by using an extrusion-molding process. The substrate thus obtained was used as an intermediate transfer belt A.

(Evaluation)

Figure 9:
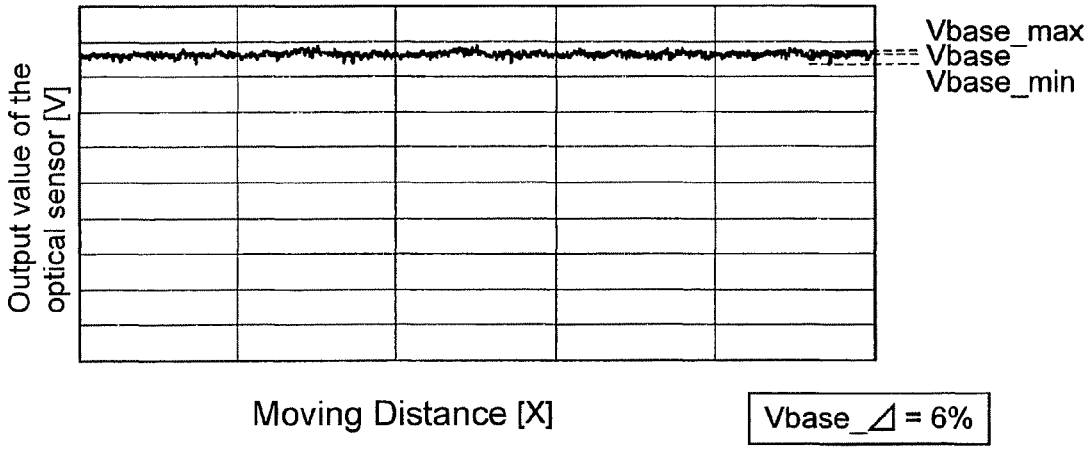
FIG. 9 is a view that shows a waveform of a belt base face output, obtained by detecting the intermediate transfer member manufactured in Experimental Example 1 (Reference Example) by using an optical sensor.

The intermediate transfer belt A was attached to a printer (bizhub C450, made by Konica Minolta Business Technologies, Inc.) having a structure shown in FIG. 1, and under the following conditions, the output of the belt base face was measured by an optical sensor, with the belt being driven. With respect to the other printer conditions, standard conditions of the printer were adopted. FIG. 9 shows the results of the measurements.

[Experimental Conditions]

Thin-film layer incident angle $\theta_1$: 20°

Light emission main wavelength: 730 nm

Figure 10:
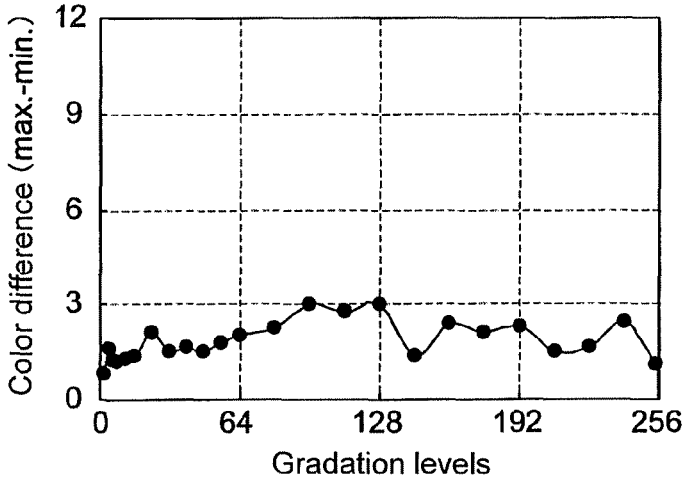
FIG. 10 is a view that shows fluctuations in image density upon image-stabilizing by the use of the same intermediate transfer member as that of FIG. 9.

A plurality of sets of experiments, which carried out the above-mentioned operation of the image-stabilizing control and then took an image sample for each gradation so that the density of each gradation was measured, were conducted, and the color difference for each of the gradation densities thus obtained was plotted. FIG. 10 shows the results. The density measurement was carried out at arbitrary one point for each of the gradations by using a Spectrolino (made by Gretag-Macbeth A G) so that the difference between the maximum value and the minimum value was evaluated as the color difference.

In general, it is considered that, when the color difference is kept within 5, changes in image quality are hardly recognizable by visual sense.

The results of the present experiment show that the intermediate transfer belt having only the substrate had a rate of an output change to the belt base face output, $V_{base}_\Delta$ (= $[V_{base_max} - V_{base_min}]/V_{base}$), of about 6%, and the maximum color difference at this time can satisfy 5 or less to all the gradation levels.

Experimental Example 2

Comparative Example (Production of Transfer Belt)

A $SiO_2$ thin-film layer having a thickness of 320 nm was formed on the peripheral surface of the seamless shaped substrate obtained in Experimental Example 1, by using an atmospheric pressure plasma CVD method so that an intermediate transfer belt B was obtained.

(Evaluation)

The same method as that of Experimental Example 1 was used except that the intermediate transfer belt B was adopted so that the evaluation was carried out.

Figure 11:
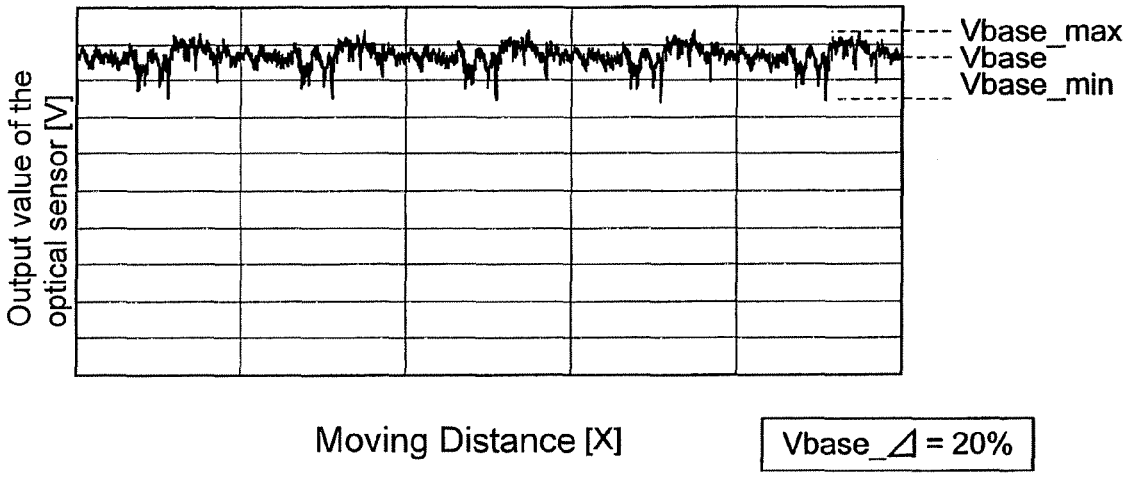
FIG. 11 is a view that shows a waveform of a belt base face output, obtained by detecting the intermediate transfer member manufactured in Experimental Example 2 (Comparative Example).

The output of the belt base face was measured with the belt being driven, and the results of the measurements are shown in FIG. 11 as a graph.

Figure 12:
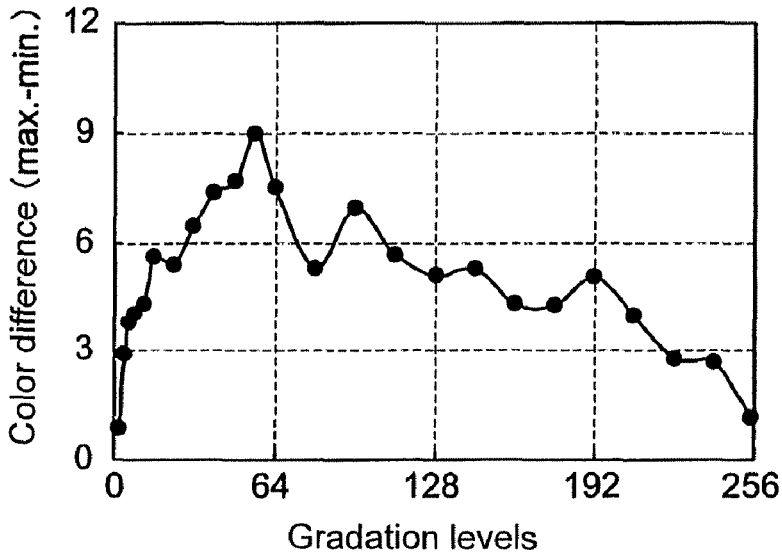
FIG. 12 is a view that shows fluctuations in image density upon image-stabilizing by the use of the same intermediate transfer member as that of FIG. 11.

FIG. 12 shows a graph obtained by plotting the color difference for each of gradation densities.

The results of the present experiments show that, when the intermediate transfer belt B with a $SiO_2$ thin-film layer having a thickness of 320 nm was used, the rate of an output change to the belt base face output $V_{base}_\Delta$ deteriorated to about 20%, with the result that the maximum color difference at this time became 5 or more, in particular, over a range from a low density portion to an intermediate density portion. Presumably, this problem is caused by the fact that fluctuations on the belt base face became greater to cause noise components due to the fluctuations on the belt base face to be detected together with a fine detection signal of an amount of adhered toner, in particular, within an area having a small amount of adhered toner, with the result that a detection error became greater. The fluctuations on the base face are caused by the generation of optical interferences due to influences of the optical characteristics between the optical sensor and the thin-film layer caused by the formation of the thin-film layer on the substrate, in addition to fluctuations in the optical thickness of the pattern detection unit due to fluctuation factors such as fluctuations in the thickness and jouncing of the belt thin-film layer, caused by the detecting operation carried out with the intermediate transfer belt being driven, and subsequent accelerated degree of the optical interference.

Experimental Example 3

Figure 13:
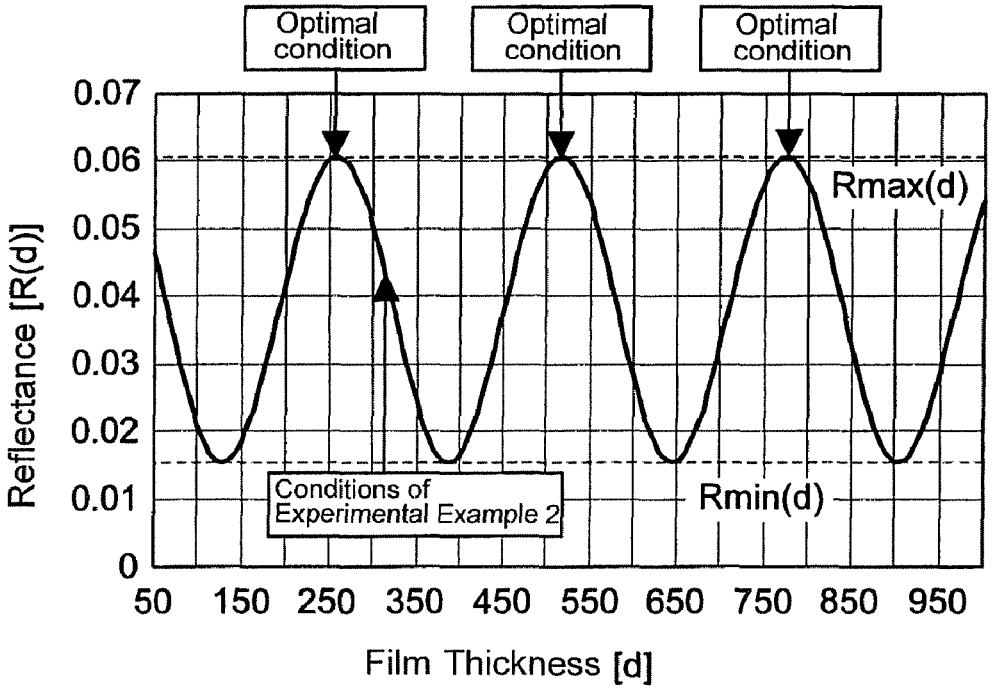
FIG. 13 is a view that shows the relationship between a reflectance function R(d) and the thickness d of a thin-film layer in the case when an intermediate transfer member having a single thin-film layer formed on a substrate satisfies conditions of Experimental Example 3.

By substituting the following calculation conditions for the above-mentioned reflectance function R(d) in the case when the intermediate transfer belt has a single layer structure having a single outermost surface thin-film layer formed on the substrate, the results are plotted on a graph shown in FIG. 13.

[Calculation Conditions]

Substrate refractive index ($n_3$): 1.65 (polyphenylene sulfide: PPS)

Substrate thickness: 150 μm

Thin-film layer refractive index ($n_2$): 1.45 ($SiO_2$)

Thin-film layer incident angle ($\theta_1$): 20°

Light-emission main wavelength ($\lambda$): 730 nm

Air layer refractive index ($n_1$): 1

Substrate incident angle ($\theta_2$): 13.6°

Incident angle ($\theta_3$): 12.0°

Since the conditions of the above-mentioned Experimental Example 2 are set to points at which the reflectance greatly changes due to fluctuations in the thickness as shown by the points shown in FIG. 13, the base face fluctuations also become greater subsequently.

In order to reduce the fluctuations of the belt base face, the conditions can be set so as to minimize the rate of a change in reflectance (point with Rmax (d) which maximizes the reflectance obtained by the reflectance function), and the optimal thickness condition under the above-mentioned conditions corresponds to a thickness condition of about integer multiple of 260 nm.

Experimental Example 4

(Production of Transfer Belt)

A $SiO_2$ thin-film layer having a thickness of 260 nm was formed on the peripheral surface of the seamless shaped substrate obtained in Experimental Example 1 by using an atmospheric pressure plasma CVD method so that an intermediate transfer belt C was obtained.

(Evaluation)

The same method as that of Experimental Example 1 was used except that the intermediate transfer belt C was adopted so that the evaluation was carried out.

Figure 14:
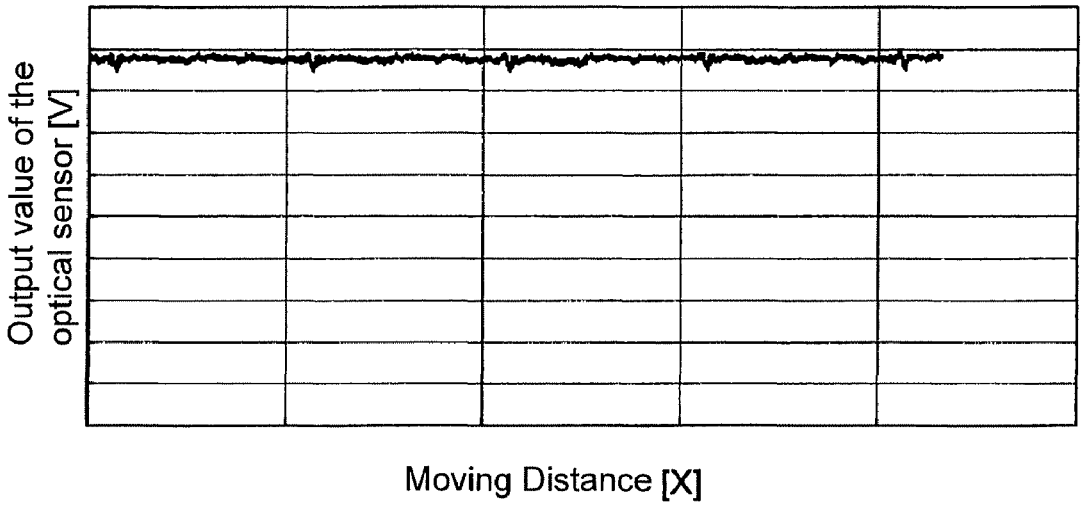
FIG. 14 is a view that shows a waveform of a belt base face output, obtained by detecting the intermediate transfer member manufactured in Experimental Example 4 by using an optical sensor.

The output of the belt base face was measured with the belt being driven, and the results of the measurements are shown in FIG. 14 as a graph.

The output of the belt base face of FIG. 14 has a rate of an output change to the belt base face output, $V_{base}_\Delta$, of less than 6% (about 1.85) so that by optimizing the thickness condition, superior results can be obtained.

Experimental Example 5

As described above, by optimizing thickness conditions, the superior results that were hardly influenced by thin-film interference were obtained, and the permissible difference was further confirmed by using the same conditions as those of Experimental Example 3.

(Production of Transfer Belt)

Only one $SiO_2$ thin-film layer having each of the following thicknesses was formed on the peripheral surface of the seamless shaped substrate obtained in Experimental Example 1 by using an atmospheric pressure plasma CVD method so that various intermediate transfer belts were obtained.

Thin-film thickness: 210 nm, 220 nm, 230 nm, 240 nm, 250 nm, 260 nm (optimal thickness condition), 270 nm, 280 nm, 290 nm, 300 nm, and 310 nm Supposing that the reflectance at the maximum value (=optimal thickness condition) that the reflectance function R(d) can take is $R_{max}$ (d) and that the reflectance at the minimum value (=worst thickness condition) that the reflectance function R(d) can take is $R_{mix}$ (d), the reflectance R(d) under each of the thickness conditions can be represented by the following equation:

$$R(d)=a\times\{R_{max}(d)-R_{min}(d)\}+R_{min}(d)$$

d: thin-film layer thickness (0<d<1000 nm)

$R_{max}$ (d): the maximum value that the reflectance function R(d) can take (=0.0607)

$R_{min}$ (d): the minimum value that the reflectance function R(d) can take (=0.0154)

a: coefficient indicating a ratio between the reflectance $R_{max}$ (d) under the optimal thickness condition and the reflectance for each of thicknesses.

The calculated values and measured values of the present experiment are shown in Table 1.

TABLE 1

| D (nm) | R (d) | a | $V_{base}_\Delta$ |
|---|---|---|---|
| 210 | 0.0473 | 0.7045 | 6.5140 |
| 220 | 0.0519 | 0.8073 | 5.0643 |
| 230 | 0.0558 | 0.8920 | 2.8504 |
| 240 | 0.0586 | 0.9542 | 2.7720 |
| 250 | 0.0603 | 0.9907 | 2.1576 |
| 260 | 0.0607 | 0.9996 | 1.8514 |
| 270 | 0.0598 | 0.9804 | 2.2440 |
| 280 | 0.0577 | 0.9342 | 3.4956 |

TABLE 1-continued

| D (nm) | R (d) | a | $V_{base}_\Delta$ |
|---|---|---|---|
| 290 | 0.0545 | 0.8632 | 4.0538 |
| 300 | 0.0503 | 0.7713 | 5.0560 |
| 310 | 0.0454 | 0.6633 | 7.9850 |

The rate of an output change to the belt base face output, $V_{base}_\Delta$, was found by using the same method as in Experimental Example 1 except that a predetermined intermediate transfer belt was adopted.

R(d) represents a value read from FIG. 13.

Figure 15:
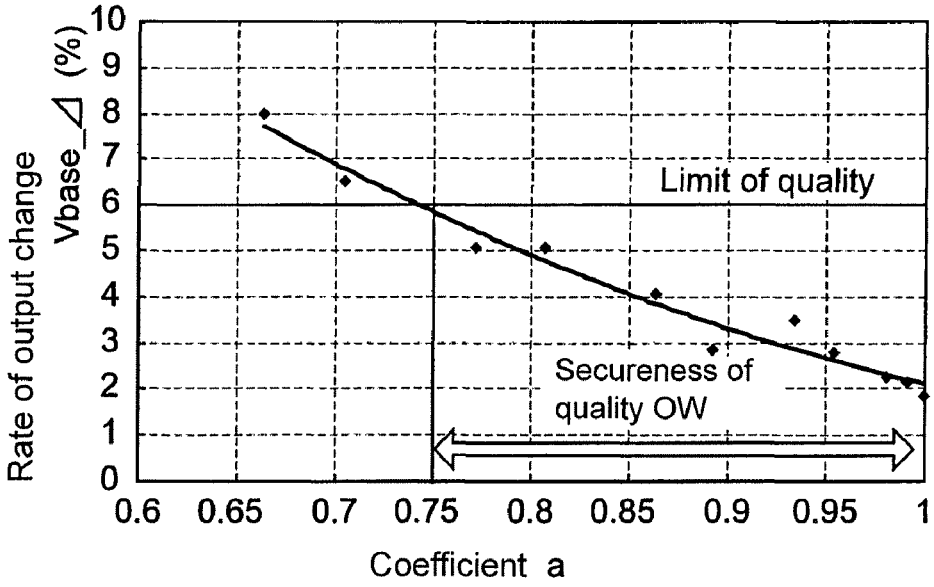

The relationship between the rate of an output change to the belt base face output, $V_{base}_\Delta$, and the coefficient a is shown in FIG. 15.

As described earlier, in order to satisfy a maximum color difference of 5 or less, it is necessary to restrain the rate of an output change to the belt base face output, $V_{base}_\Delta$, to about 6% or less.

It has been confirmed by the present experiments that in order to restrain the rate of an output change to the belt base face output to 6% or less, the thickness needs to be set so as to allow the reflectance ratio coefficient a to become 0.75 or more. It has also been confirmed that in order to restrain the rate of an output change to the belt base face output to 5% or less, the thickness needs to be preferably set so as to allow the reflectance ratio coefficient a to become 0.85 or more. It has also been confirmed that in order to restrain the rate of an output change to the belt base face output to 3% or less, the thickness needs to be more preferably set so as to allow the reflectance ratio coefficient a to become 0.95 or more.

What is claimed is:

1. An image-forming apparatus, comprising:

an image-supporting member, an optical sensor that includes a light source unit which applies light having a light-emission main wavelength λ to a peripheral face of the image-supporting member, and a light-receiving unit which receives a reflected light thereof, so as to optically detect a toner pattern formed on a peripheral face of the image-supporting member, wherein the image-supporting member has at least one thin-film layer formed on the peripheral face thereof, and the thickness of an outermost surface thin-film layer is set so as to allow a reflectance function R(d) that indicates the relationship between a reflectance R of the peripheral face of the image-supporting member to light having a light-emission main wavelength λ from the light source unit and a thickness d (nm) of the outermost surface thin-film layer of the image-supporting member to satisfy the following conditional expression:

$$R(d) \geqq 0.75 \times \{R_{max}(d) - R_{min}(d)\} + R_{min}(d)$$

in which d is set in a range of 0<d<1000 nm;

$R_{max}$ (d) is a maximum value that the reflectance function R(d) is allowed to have; and $R_{min}$ (d) is a minimum value that the reflectance function R(d) is allowed to have.

2. The image-forming apparatus according to claim 1, wherein the reflectance function R(d) that indicates the relationship between the reflectance R of the peripheral face of the image-supporting member to light having a light-emission main wavelength λ from the light source unit and the thickness d (nm) of the outermost surface thin-film layer of the image-supporting member is allowed to satisfy the following conditional expression:

$$R(d) \geqq 0.85 \times \{R_{max}(d) - R_{min}(d)\} + R_{min}(d).$$

3. The image-forming apparatus according to claim 1, wherein the reflectance function R(d) that indicates the relationship between the reflectance R of the peripheral face of the image-supporting member to light having a light-emission main wavelength λ from the light source unit and the thickness d (nm) of the outermost surface thin-film layer of the image-supporting member is allowed to satisfy the following conditional expression:

$$R(d) \geqq 0.95 \times \{R_{max}(d) - R_{min}(d)\} + R_{min}(d).$$

4. The image-forming apparatus according to claim 1, wherein the thin-film layer is an inorganic oxide layer formed by using an atmospheric pressure plasma CVD method.

5. An image-forming method, which transfers a toner image formed on an image-supporting member onto a recording medium to form an image thereon, comprising the steps of:

forming a toner pattern on a peripheral face of the image-supporting member having at least one thin-film layer on the peripheral face thereof;

applying light having a light-emission main wavelength λ, to the peripheral face of the image-supporting member;

receiving reflected light of the applied light from the image-supporting member; and carrying out image-stabilizing control, which sets toner image forming conditions based upon the intensity of the reflected light thus received, wherein a reflectance function R(d) that indicates the relationship between a reflectance R of the peripheral face of the image-supporting member to light having a light-emission main wavelength λ, and a thickness d (nm) of an outermost surface thin-film layer of the image-supporting member is allowed to satisfy the following conditional expression:

$$R(d) \geqq 0.75 \times \{R_{max}(d) - R_{min}(d)\} + R_{min}(d)$$

in which, d is set in a range of 0<d<1000 nm;

$R_{max}$ (d) is a maximum value that the reflectance function R(d) is allowed to have; and $R_{min}$ (d) is a minimum value that the reflectance function R(d) is allowed to have.

6. The image-forming method according to claim 5, wherein the reflectance function R(d) that indicates the relationship between the reflectance R of the peripheral face of the image-supporting member to light having a light-emission main wavelength λ from a light source unit and the thickness d (nm) of the outermost surface thin-film layer of the image-supporting member is allowed to satisfy the following conditional expression:

$$R(d) \geqq 0.85 \times \{R_{max}(d) - R_{min}(d)\} + R_{min}(d).$$

7. The image-forming method according to claim 5, wherein the reflectance function R(d) that indicates the relationship between the reflectance R of the peripheral face of the image-supporting member to light having a light-emission main wavelength λ, from a light source unit and the thickness d (nm) of the outermost surface thin-film layer of the image-supporting member is allowed to satisfy the following conditional expression:

$$R(d) \geqq 0.95 \times \{R_{max}(d) - R_{min}(d)\} + R_{min}(d).$$

8. The image-forming method according to claim 5, wherein the thin-film layer is an inorganic oxide layer formed by using an atmospheric pressure plasma CVD method.

* * * * *